US008568114B2

(12) United States Patent
Masuda et al.

(10) Patent No.: US 8,568,114 B2
(45) Date of Patent: Oct. 29, 2013

(54) RECIPROCATING PUMP

(75) Inventors: Akihiro Masuda, Hyogo (JP); Mitsuo Mori, Hyogo (JP)

(73) Assignee: Nippon Pillar Packing Co., Ltd., Yodogawa-ku, Osaka-shi, Osaka (JP)

( * ) Notice: Subject to any disclaimer, the term of this patent is extended or adjusted under 35 U.S.C. 154(b) by 430 days.

(21) Appl. No.: 12/451,915

(22) PCT Filed: Apr. 2, 2008

(86) PCT No.: PCT/JP2008/056576

§ 371 (c)(1),
(2), (4) Date: Dec. 7, 2009

(87) PCT Pub. No.: WO2008/149597

PCT Pub. Date: Dec. 11, 2008

(65) Prior Publication Data

US 2010/0119392 A1 May 13, 2010

(30) Foreign Application Priority Data

Jun. 6, 2007 (JP) ..... 2007-150023

(51) Int. Cl.
*F04B 43/00* (2006.01)
*F04B 45/02* (2006.01)
*F16C 33/02* (2006.01)

(52) U.S. Cl.
USPC ..... 417/473; 417/472; 384/296

(58) Field of Classification Search
USPC ..... 417/472, 473, 531, 538, 375; 384/26, 384/29, 42, 215, 222, 276, 295, 296
See application file for complete search history.

(56) References Cited

U.S. PATENT DOCUMENTS

| | | | | | |
|---|---|---|---|---|---|
| 2,312,837 | A * | 3/1943 | Jennings | 417/68 |
| 5,035,519 | A * | 7/1991 | Aizawa et al. | 384/121 |
| 5,192,137 | A * | 3/1993 | Renard | 384/275 |
| 5,558,444 | A * | 9/1996 | Ide | 384/122 |
| 5,562,347 | A * | 10/1996 | Hsieh | 384/215 |
| 5,601,370 | A * | 2/1997 | Shibayama et al. | 384/215 |
| 6,485,180 | B2 * | 11/2002 | Mena | 384/222 |
| 7,056,027 | B2 * | 6/2006 | Puckett | 384/276 |
| 7,220,056 | B2 * | 5/2007 | Kubota et al. | 384/215 |
| 7,665,747 | B2 * | 2/2010 | Arlt | 280/93.514 |
| 8,061,972 | B2 * | 11/2011 | Maier | 415/118 |
| 2005/0191195 | A1 * | 9/2005 | Oniduka et al. | 417/473 |
| 2009/0000853 | A1 * | 1/2009 | Hirose et al. | 180/400 |

FOREIGN PATENT DOCUMENTS

| | | | |
|---|---|---|---|
| JP | 2002 174180 | | 6/2002 |
| JP | 2002174180 | A * | 6/2002 |
| JP | 2004 197689 | | 7/2004 |
| JP | 2005 214014 | | 8/2005 |

* cited by examiner

*Primary Examiner* — Peter J Bertheaud
(74) *Attorney, Agent, or Firm* — Bacon & Thomas, PLLC

(57) ABSTRACT

A reciprocating pump having: a pump body including a suction path and a discharge path for a fluid; a pair of diaphragms; pump shafts which are attached to tip end portions of the diaphragms; a pair of pump flanges which slidably support the pump shafts, and which are integrated with the pump body through connection bodies that are placed outside the diaphragms; connecting rods which connect connecting plates attached to projecting tip-end portions that are projected from the pump flanges in the pump shafts, to each other in a state where the connecting rods are passed through the pump flanges to be placed outside the diaphragms; and a cover cylinder. The connecting rods are slidably supported through slide bearings which are supported by the pump flanges.

7 Claims, 8 Drawing Sheets

RECIPROCATING PUMP

TECHNICAL FIELD

The present invention relates to a reciprocating pump which is a bellows pump, a diaphragm pump, or the like, and which is suitable as liquid transporting means for pure water or medical solution and to be used in equipment or apparatus for producing a semiconductor or liquid crystal.

BACKGROUND ART

A reciprocating pump of this kind is a large-capacity (the discharge amount per unit time is large) reciprocating pump in which one pair of diaphragms such as bellows are mounted in a back-to-back configuration in the pump body, and tip end portions of the diaphragms are interlockingly connected to each other by connecting rods which are placed in the lateral outsides so as to detour around the diaphragms, whereby the pair of diaphragms are complementarily expanded and contracted to continuously perform pumping. For example, the pump disclosed in Patent Reference 1 is known.

As shown in FIG. 2 of Patent Reference 1, namely, in order to complementarily expand and contract bellows 12*a*, 12*b* which are opposedly placed, connecting plates 32*a*, 32*b* fixed to pump shafts 24*a*, 24*b* attached to the tip ends of the bellows 12*a*, 12*b* are interlockingly connected to each other by a pair of connecting rods 34*a*, 34*b*, and the pair of pump shafts 24*a*, 24*b*, the pair of connecting plates 32*a*, 32*b*, and the pair of connecting rods 34*a*, 34*b* are reciprocally moved as an integral moving body.

Means for slidably supporting the moving body which is configured by the plural components as described above allows the pump shafts 24*a*, 24*b* to be passed through holes 22*a*, 22*b* of pump flanges 1*a*, 1*b* through bearings 23*a*, 23*b*. Namely, the moving body which is a large structure has a configuration which is slidably supported only by the pump shafts 24*a*, 24*b*.

Patent Reference 1: JP-A-2002-174180

DISCLOSURE OF THE INVENTION

Problems to be Solved by the Invention

In the configuration which is slidably supported only by the pump shafts, all the weights of the pump shafts, the connecting rods, the connecting plates, and the bellows connected to the pump shafts act on the pump shafts, and the weight load is large. Therefore, the load against the pump shaft bearings 23*a*, 23*b* equipped in the pump flanges is large, so that the bearings tend to be easily worn, and there is a possibility that it is difficult to smoothly perform the slide movement of the moving body.

It is an object of the invention to improve the structure so that a bearing is disposed in a place other than pump shafts, thereby improving the smoothness of the slide movement of the above-described moving body which is a large structure, and the durability of slide supporting means (bearings or the like) for it.

Means for Solving the Problems

The invention is characterized in that a reciprocating pump has: a pump body 1 comprising a suction path 12 and discharge path 13 for a to-be-transported fluid; a pair of diaphragms 2, 2 which are airtightly fixed to both end portions of the pump body 1, respectively, and which are opposedly placed to form closed spaces 8 with respect to the pump body 1, respectively; pump shafts 15 which are attached to tip end portions of the diaphragms 2; a pair of pump flanges 4, 4 which slidably support the pump shafts 15, 15, and which are integrated with the pump body 1 through connection bodies 16 that are placed outside the diaphragms 2, 2; connecting rods 18 which connect connecting plates 17 attached to passing projecting portions 15B that are outward projected from the pump flanges 4 in the pump shafts 15, 15, to each other in a state where the connecting rods are passed through the pump flanges 4, 4 to be placed outside the diaphragms 2; and a cover cylinder 6 which surrounds the connecting rods 18 in a state where the cover cylinder is disposed between the pair of pump flanges 4, 4, and the connecting rods 18 are slidably supported through slide bearings 27 which are supported by the pump flanges 4, 4.

The invention is characterized in that, in the reciprocating pump, the slide bearings 27 are formed into a slit cylindrical shape which is fitted onto the connecting rods 18 having a circular section, and in which a slit 28 extending along a direction of an axis X of the circular connecting rods 18 is formed, and a section is formed into a C-like shape.

The invention is characterized in that, in the reciprocating pump, end portions of the cover cylinder 6 having a circular pipe-like shape are fitted and supported by the slide bearings 27.

The invention is characterized in that, in the reciprocating pump, the slide bearings 27 are formed into a stepped shape having: a small-diameter portion 27*b* onto which the cover cylinder 6 is fitted; and a large-diameter portion 27*a* which is larger in diameter than the small-diameter portion 27*b*, and which is fitted into a recessed portion 24 disposed in the pump flange 4.

The invention is characterized in that, in the reciprocating pump, in order to detachably support bearing mechanisms B which slidably support the pump shafts 15, by the pump flanges 4, cassette members 19 equipped with ring-like bearings 21 and seal rings 22 which are fitted onto the pump shafts 15 are attached to the pump flanges 4 in a state where the cassette members are enabled to be detached from the pump flanges 4 toward the connecting plates 17.

The invention is characterized in that, in the reciprocating pump, the diaphragms 2 are formed into a bellows having: a thick flange portion 2*a* which is attached to the pump body 1; a tip-end thick plate portion 2*c* which is attached to a plate-like member 14 equipped in a root portion of the pump shaft 15; and a bellows portion 2*b* which is formed in a state where the bellows portion extends over the thick flange portion 2*a* and the tip-end thick plate portion 2*c*.

Effects of the Invention

According to the invention, in a moving body configured by the pair of pump shafts which are attached to tip end portions of the bellows, the pair of connecting plates, the plural connecting rods, and the like, not only the portions of the pump shafts, but also the both end portions of the connecting rods are slidably supported. Therefore, the load burden, which is concentrated to the pump shafts in the prior art, is distributed also to bearing portions of the connecting rods, and hence it is possible to provide a reciprocating pump in which wear of slide bearings can be suppressed, and the life period can be prolonged. In the moving body which is a relatively large structure, furthermore, portions of slide bearings are remarkably increased. Therefore, also the stabilization and smoothness of movement of the moving body can be improved, and also an advantage that the pump can be operated more smoothly and lightly can be obtained.

According to the invention, the slide bearings of the connecting rods are formed into a slit cylindrical shape in which a section is formed into a C-like shape, and therefore it is possible to provide a reciprocating pump in which, even when the slide bearings and the connection rods are expanded or contracted by a change of the ambient temperature, sliding heat, or the like, the slide bearings are easily expandingly or contractingly displaced in the circumferential direction, so that the expansion or the contraction can be absorbed, and an excellent sliding supporting state between the connection rods and the slide bearings can be maintained.

The invention has the structure where the cover cylinder which surrounds the connecting rods in order to protect them is fitted and supported by the slide bearings, i.e., the structure where the cover cylinder is fitted through one component (slide bearings). As compared with the case where a cover cylinder is fitted through two components (pump flanges, and slide bearings), such as the case where a cover cylinder is fitted and supported by pump flanges, therefore, there are advantages such as that the cover cylinder can be assembled with a higher dimensional accuracy, and that a cylinder having a smaller diameter which is closer to the diameter of the connection rods can be used. In this case, when, the slide bearings are formed into a stepped shape having: a small-diameter portion onto which the cover cylinder is fitted; and a large-diameter portion which is fitted into the pump flange, there are additional advantages such as that the cover cylinder can be made thinner, and that the inner diameter of holes of the pump flanges and for attaching the slide bearings can be formed as a constant diameter which is economical and easily produced, and which does not form a step.

In the configuration where the cover cylinder is fitted and supported by the slide bearings, when the slide bearings are to be attached to or detached from the pump flanges in order to perform maintenance such as maintenance check or replacement of the slide bearings, operations of attaching and detaching the slide bearings with respect to the pump flanges, and those of attaching and detaching the slide bearings and the cover cylinder in a state of a small structure which is configured by the slide bearing and the cover cylinder, and which is detached from the pump flanges are conducted. This is cumbersome because, in the case where the cover cylinder is fitted and supported with respect to the pump flanges, for example, both the operations of attaching and detaching the cover cylinder with respect to the pump flanges, and those of attaching and detaching the slide bearings with respect to the pump flanges must be conducted in the reciprocating pump. In the invention, there is a further advantage that the cumbersome operation is improved and the attaching and detaching operations can be facilitated.

According to the invention, although described in detail in the paragraph of embodiments, the bearing mechanisms which slidably support the pump shafts can be detached from the pump flanges toward the connecting plates, i.e., toward the outside. In maintenance check or replacement of bearings means or sealing means for the pump shafts, therefore, only a work of detaching the connecting plates from the connecting rods is requested in addition to operations of detaching and attaching the bearing mechanisms. Therefore, an advantage is obtained that, as compared with a conventional reciprocating pump in which also pump flanges must be detached and attached in addition to connecting plates, the maintenance property of the slide supporting structure for the pump shafts can be improved.

According to the invention, it is possible to provide a bellows reciprocating pump which has the above-described effects of any one of claims 1 to 5, and which is easy to use and improved.

BEST MODE FOR CARRYING OUT THE INVENTION

Figure 1:
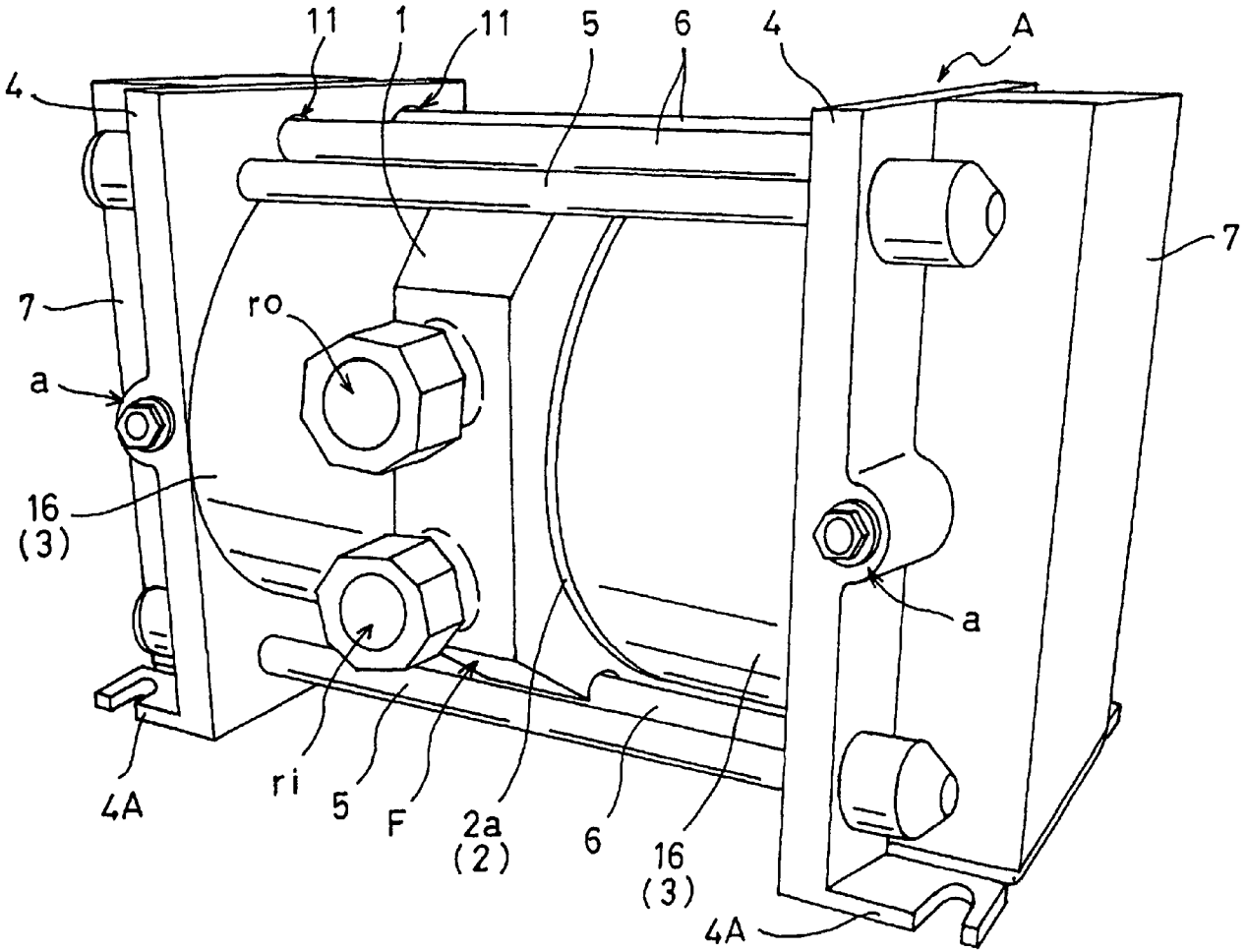
FIG. 1 is a whole perspective view showing the appearance of a reciprocating pump.
Figure 4:
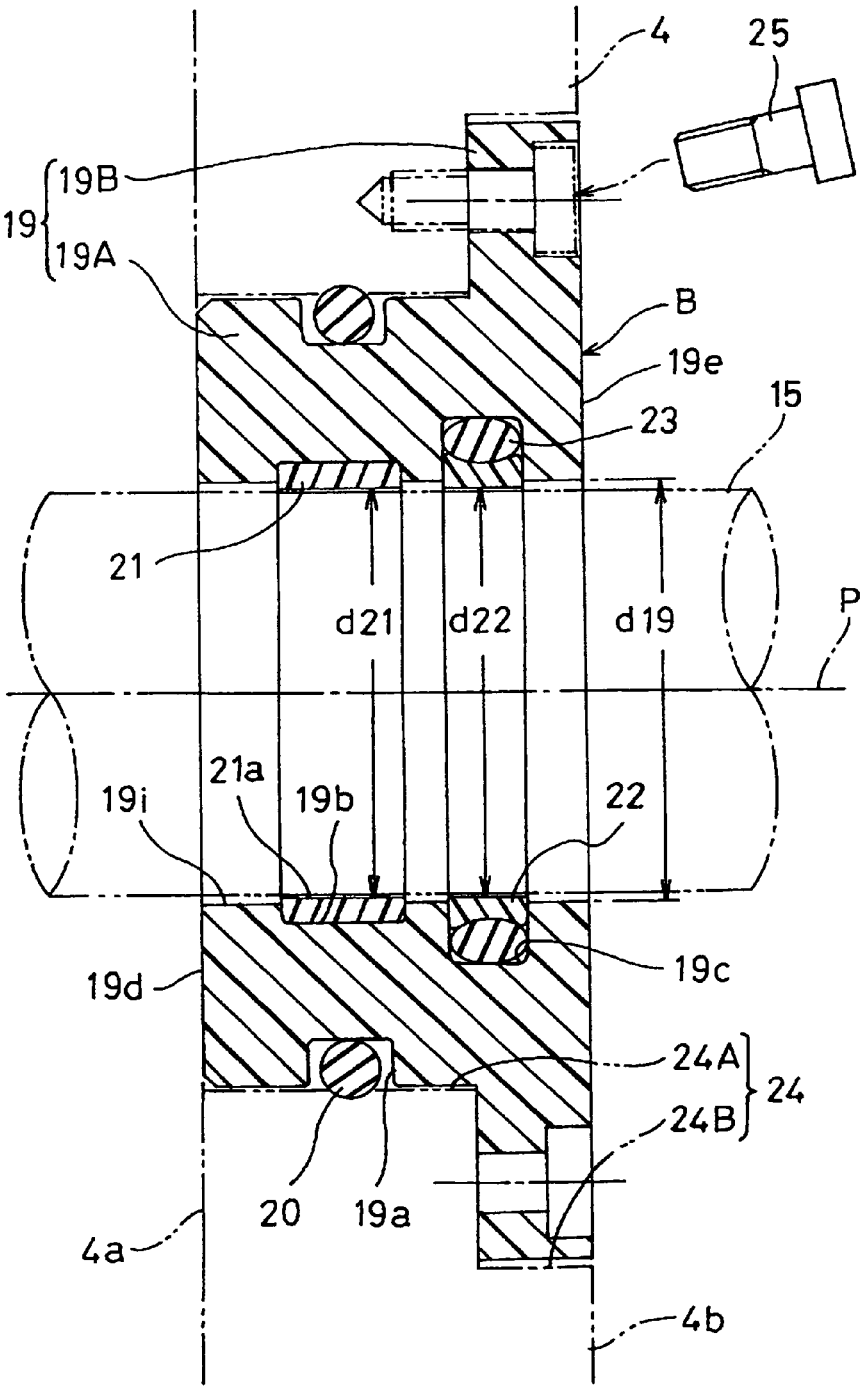
FIG. 4 is an enlarged sectional view of main portions showing a supporting structure for a pump shaft.
Figure 5:
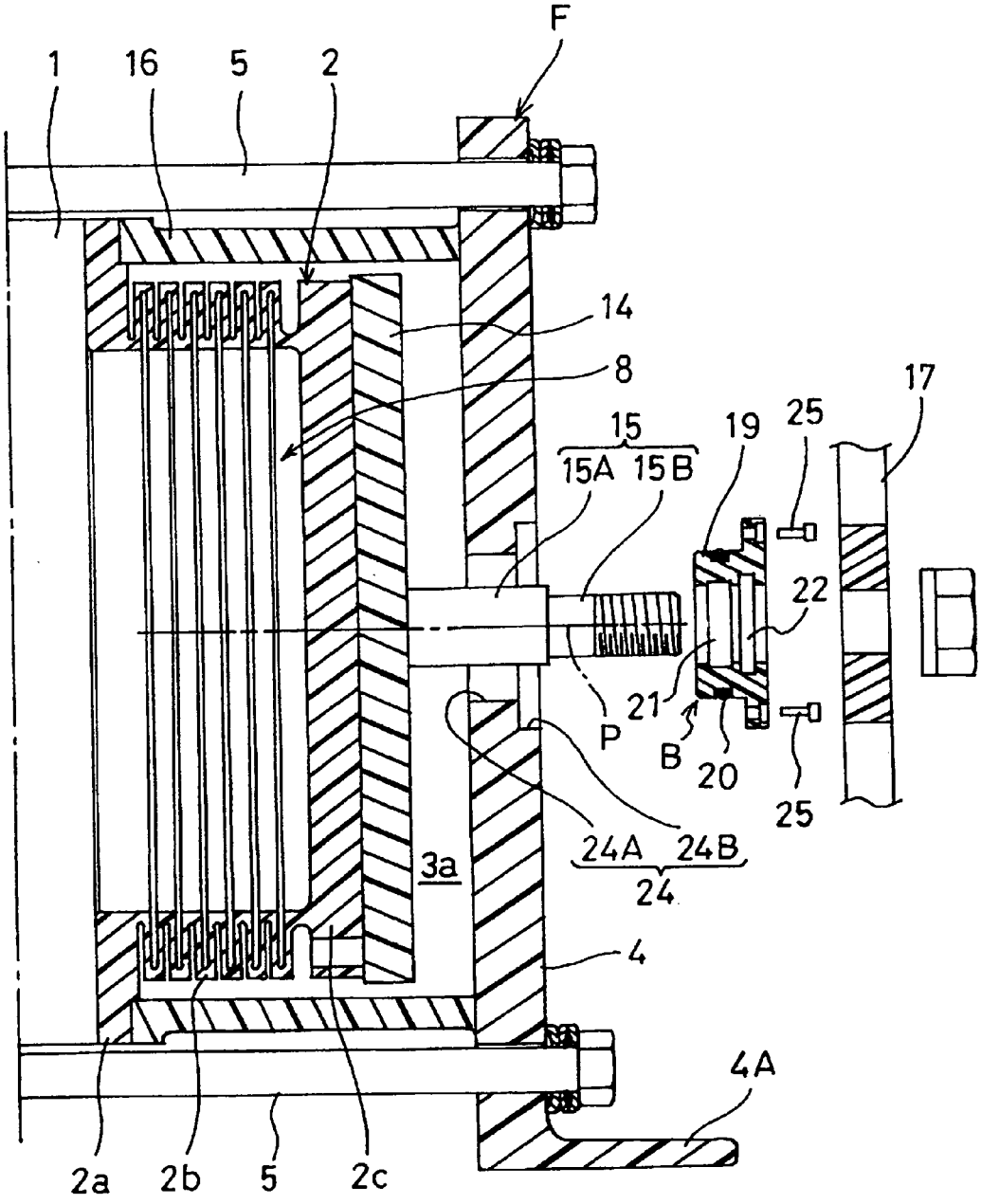
FIG. 5 is an operation view showing an attaching/detaching structure of a cassette sliding portion.
Figure 6:
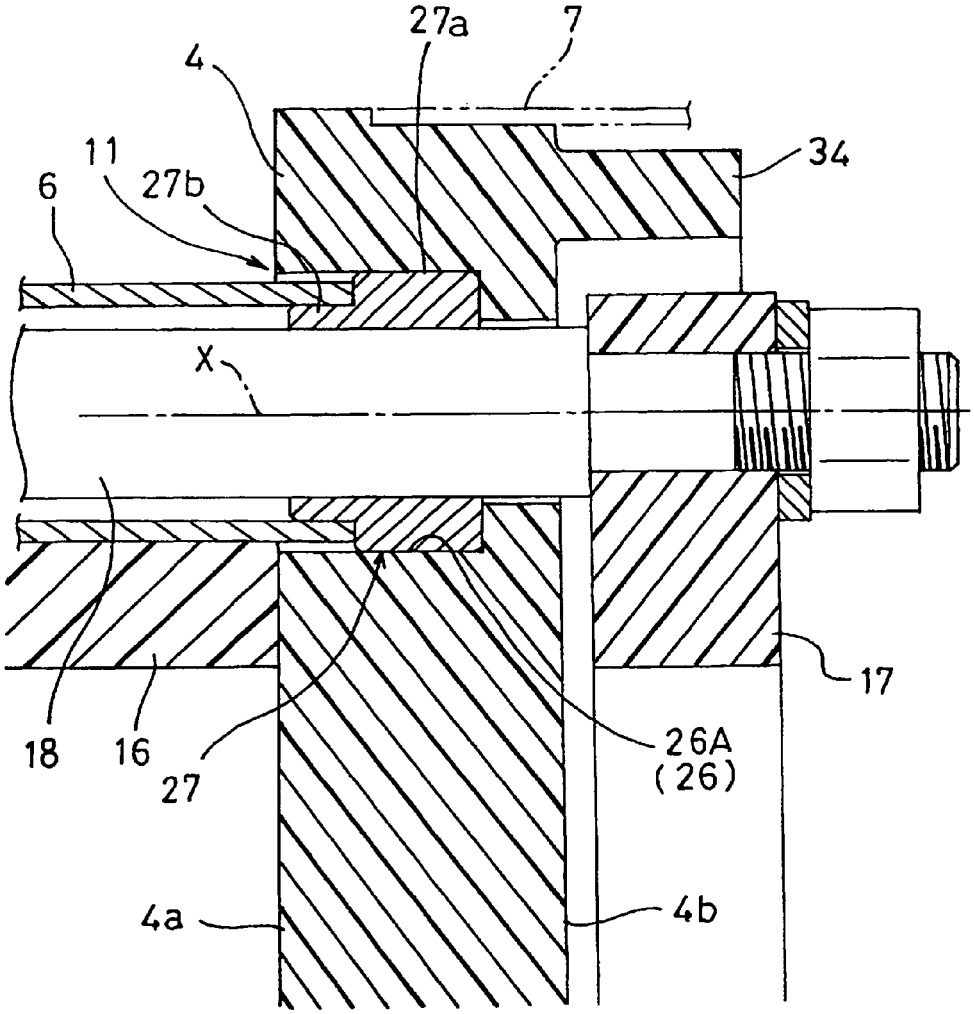
FIG. 6 is an enlarged sectional view of main portions showing a supporting structure for a connecting rod.
Figure 7:
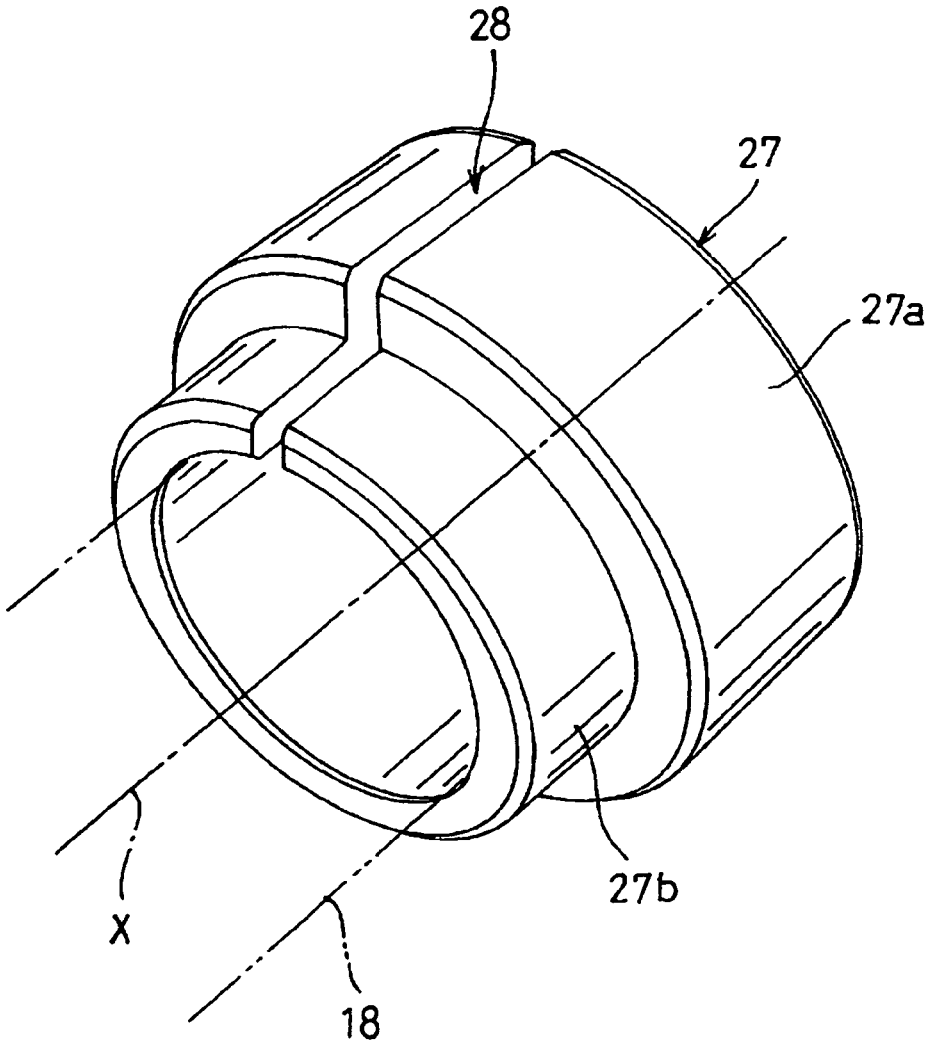
FIG. 7 is a perspective view of a single slide bearing which is used in the supporting structure of FIG. 6.

Hereinafter, an embodiment of the reciprocating pump of the invention will be described with reference to the drawings. FIG. 1 is a whole perspective view of the reciprocating pump, FIG. 2 is a sectional view showing the structure, FIG. 3 is a side view, FIG. 4 is a sectional view of main portions showing a slide supporting structure for a pump shaft, FIG. 5 is an attaching/detaching operation view of a bearing mechanism, FIG. 6 is a sectional view showing a slide supporting structure for a connecting rod, and FIG. 7 is a perspective view of a single slide bearing of FIG. 6.

Example 1

Figure 2:
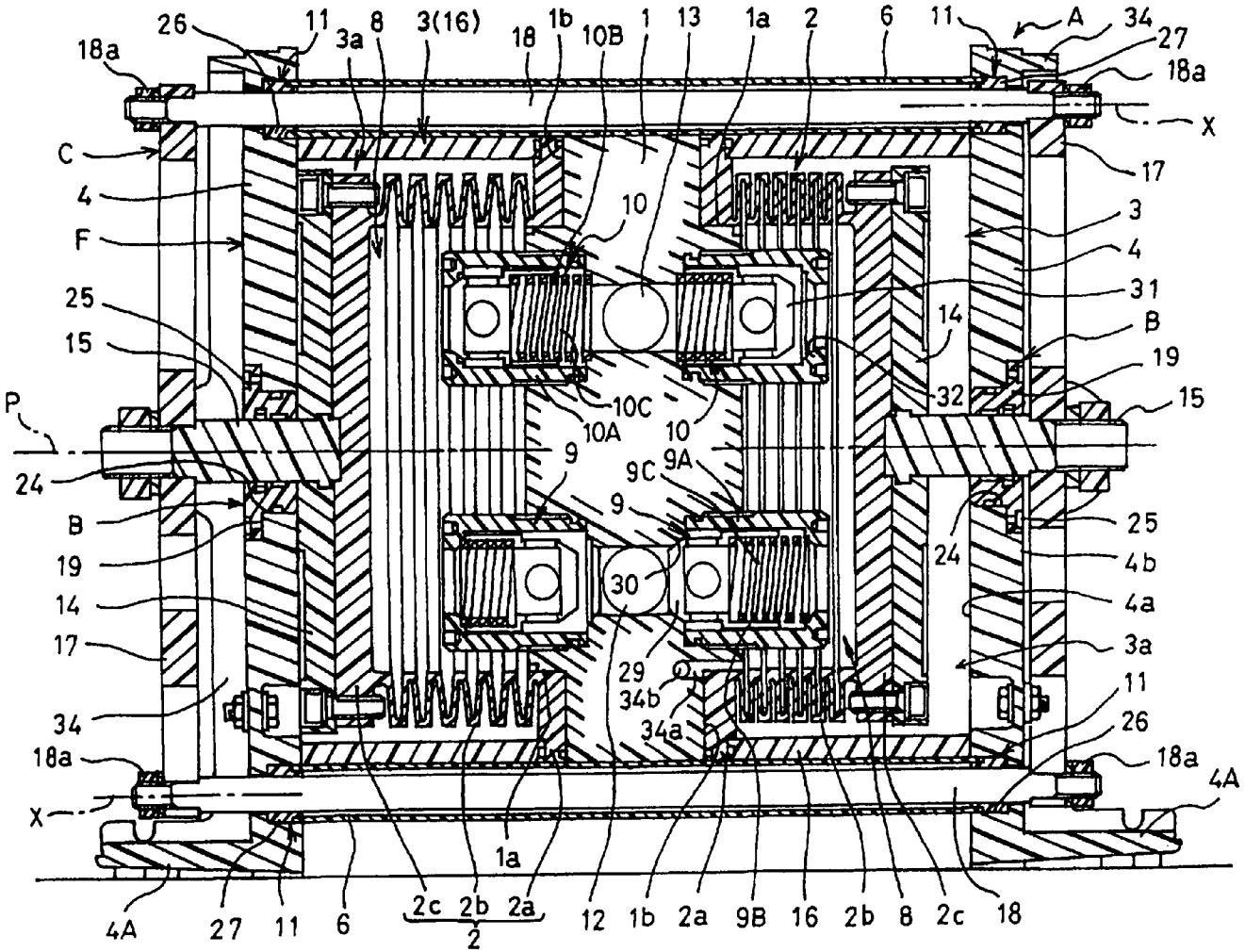
FIG. 2 is a sectional view showing the structure of the reciprocating pump of FIG. 1.
Figure 3:
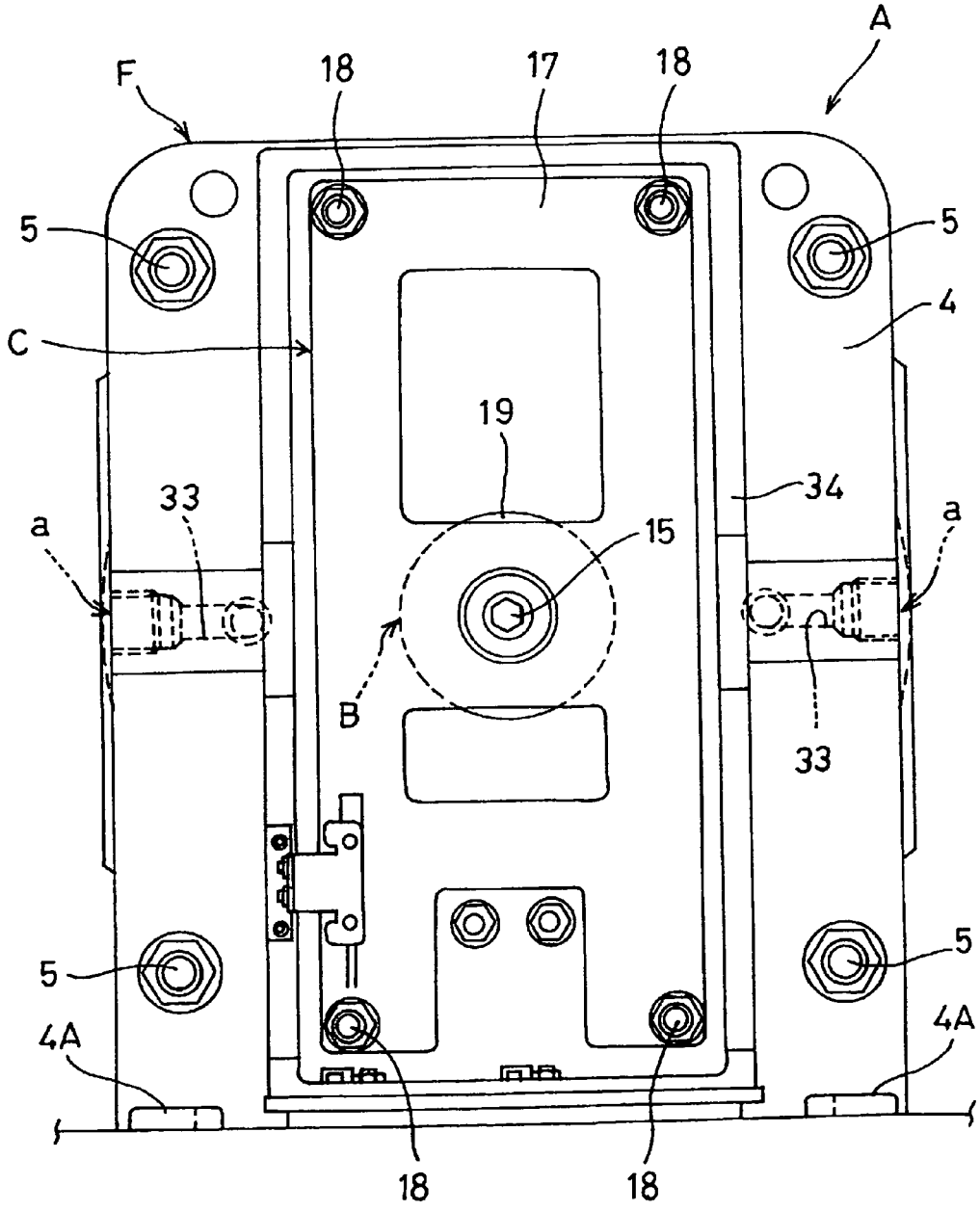
FIG. 3 is a side view of the reciprocating pump of FIG. 1.

As shown in FIGS. 1 to 3, the reciprocating pump A is a large-capacity reciprocating pump which has a structure similar to that where one pair of bellows pumps are combined with each other in a back-to-back configuration, and in which the discharge amount per unit time can be large. The reciprocating pump A is configured to have: a pump body 1 which is made of a fluororesin (PTFE) or the like, and which is in the middle in the lateral direction; a pair of bellows (an example of a diaphragm) 2, 2 which are placed in the right and left sides of the pump body 1, and which are made of a fluororesin (PTFE) or the like; a pair of air cylinders 3, 3; a pair of pump flanges 4, 4 which are made of a stainless material (SUS304) or the like; a total of four through bolt nuts 5; a total of four cover cylinders 6, 6; a pair of end covers 7, 7; and the like. FIG. 3 is a side view of a state where the end covers 7 are removed.

Hereinafter, the pumping function will be briefly described. The air is complementarily introduced and discharged with respect to air supplying/discharging ports a, a which are disposed on the sides of the pump flanges 4, 4, from an air supplying/discharging apparatus that is not shown, thereby causing the pair of air cylinders 3, 3 to complementarily expand and contract, so that a fluid which is sucked from a fluid sucking port ri that is placed below a side of the pump body 1 can be substantially continuously ejected from a fluid ejecting port ro that is placed above the fluid sucking port. Namely, the pump has a structure where the pair of the bellows 2, 2 are complementarily expandingly and contractingly driven, and, during a period when one of the bellows 2 operates to eject a fluid, the other bellows 2 operates to suck a fluid, so that, although in the reciprocating pump A, the pump can continuously eject the fluid.

Next, the structures of the parts will be described in detail. In the pump body 1, as shown in FIGS. 2 and 3, the center portions of the right and left sides are formed into a stepped cylindrical shape which is outward projected. Annular thick flange portions 2*a* of the bellows 2 are fitted until they butt against the inner peripheral wall 1*b* of the pump body 1, and supported by outer circumferential portions 1*a* of projected portions of the pump body 1, and suction and ejection check valves 9, 10 are disposed to be opposed to pump chambers (an example of a closed space) 8 which are portions surrounded by the bellows 2 and the pump body 1. In the pump body 1, a suction-side flow path (an example of a suction path) 12 through which the pair of suction check valves 9, 9 communicate with the fluid sucking port ri, and an ejection-side flow path (an example of an ejection path) 13 through which the pair of ejection check valves 10, 10 communicate with the fluid sucking port ri are formed.

Each of the suction check valves 9 is configured by: a valve case 9A which is fitted and attached to the pump body 1; a valve element 9B which is movably fitted into the valve case 9A; and a coil spring 9C which pressingly urges a valve seat 29 at the tip end of the valve element 9B against a hole peripheral edge portion 30 that is opened on the side of the suction-side flow path 12 in the pump body 1. Each of the ejection check valves 10 is configured by: a valve case 10A which is fitted and attached to the pump body 1; a valve element 10B which is movably fitted into the valve case 10A; and a coil spring 10C which pressingly urges a valve seat 31 at the tip end of the valve element 10B against a hole peripheral edge portion 32 that is formed in a state where it is opened on the side of the pump chamber 8 in the valve case 10A. In FIG. 2, the suction check valve 9 which is drawn on the right side of the pump body 1 is shown in a closed (closed valve) state, and the suction check valve 9 which is drawn on the left side is shown in an opened (opened valve) state. The ejection check valve 10 which is drawn on the right side of the pump body 1 is shown in an opened (opened valve) state, and the ejection check valve 10 which is drawn on the left side is shown in a closed (closed valve) state.

Each of the bellows 2 is configured by the above-described thick flange portion 2*a* and bellows portion 2*b*, and a head portion (an example of a tip-end thick plate portion) 2*c* which has a substantially circular shape, and a pump shaft 15 is attached to the head portion 2*c* through a supporting plate (an example of a plate-like member) 14 which is bolted to the head portion. The pump shafts 15 are equipped in a state where their centers are coincident with the axis P which passes through the centers of the bellows 2 and the pump body 1. The pump shafts 15 are slidably supported by the pump flanges 4 through cassette type bearing mechanisms B, and the pump flanges 4 are supported by the thick flange portions 2*a* through cylinder barrels (an example of a connection body) 16 constituting the air cylinders 3, by through bolt nuts 5 which are bridged between the pair of pump flanges. Namely, the pair of pump flanges 4, 4 are integrated with the pump body 1 through the aluminum alloy-made cylinder barrels 16, 16 and the thick flange portions 2*a* of the bellows 2, so that a pump frame F serving as a supporting member is configured by them. In the pump flanges 4, mounting flanges 4A for enabling the reciprocating pump A to be fixed to a structure such as a pedestal by bolts or the like are formed.

Each of the pump shafts 15 has a body portion 15A which is fitted into the bearing mechanism B, and a tip end portion (an example of a passing projecting portion) 15B which is slightly smaller in diameter than the body portion, and a connecting plate 17 which has a rectangular plate-like shape, and which is made of stainless steel (SUS304 or the like) is nutted to the tip end portion 15B which is projected while passing through the pump flange 4. A total of four columnar (or cylindrical) connecting rods 18 for interlockingly connecting the pair of connecting plates 17 to each other are fixed by nuts 18*a* to the right and left ends of the upper and lower ends of the connecting plates 17, respectively. The connecting rods 18 which are made of stainless steel (SUS304 or the like) are slidably supported on the pump flanges 4, 4 by bearing portions 11 which are disposed in the pump flanges 4, 4. Each of the connecting rods 18 is surrounded by a round pipe-like cover cylinder 6 which is bridged between the pump flanges 4, 4, and in which a fluorine resin coating is applied to stainless steel (SUS304 or the like). The connecting plates 17 are covered together with four end portions of the connecting rods 18 by the end covers 7.

Namely, the head portion 2*c* of the pair of bellows 2 are interlockingly connected to each other accompanied by a moving body C which is configured by the pair of supporting plates 14, 14 that are made by stainless steel (SUS304 or the like), the pair of pump shafts 15, 15, the pair of connecting plates 17, 17, and the four connecting rods 18. Therefore, the bellows are integrally driven in a relationship in which, when one of the bellows 2 (the bellows 2 which is drawn on the left side in FIG. 2) is expandingly moved, or i.e., when the left air cylinder 3 operates at a negative pressure, the other bellows 2 (the bellows 2 which is drawn on the right side in FIG. 2) is contractingly moved, or i.e., the right air cylinder 3 operates at a positive pressure. The pump is configured as a large-capacity reciprocating pump which, by the complementary driving of the pair of bellows 2, continuously sucks the fluid and continuously ejects the fluid. The interiors of the cylinder barrels 16 are formed into cylinder chambers 3*a* for expandingly and contractingly driving the bellows 2 by the air pressure.

The moving body C which is configured by the plural components is slidably supported on the pump frame F by the total of two bearing mechanisms B which act on the pump shafts 15, and the total of eight bearing portions 11 which act on the both end portions of the connecting rods 18. In this way, not only the pump shafts 15, but also the both end portions of the four connecting rods 18 are slidably supported through the bearings. Therefore, the support load (burden) of the moving body C is distributed to the total of ten bearings (the two bearing mechanisms B and the eight bearing portions 11), so that early wear of the bearings does not occur and the sealing property can be improved. Moreover, a slide supporting structure which allows the moving body C to slide smoothly and lightly is formed in the reciprocating pump A.

Next, the slide supporting structure for the pump shafts 15 will be described. The pump shafts 15 made of a stainless steel (SUS304 or the like) are slidably supported by the pump flanges 4 by using the above-described bearing mechanisms B. As shown in FIGS. 4 and 5, each of the bearing mechanisms B is configured to have: an aluminum alloy-made cassette member 19 which has a body boss portion 19A and an attaching flange portion 19B, and which has a stepped cylindrical shape; a first O-ring 20; a bearing ring 21; a seal ring 22; and a second O-ring 23 which is fitted onto the seal ring 22.

The first O-ring 20 is fitted into an outer circumferential groove 19*a* which is formed in the outer circumferential face of the body boss portion 19A. The bearing ring 21 is fitted into a flat inner circumferential groove 19*b* which is formed in a portion of the inner circumferential face 19*i* of the cassette member 19 and corresponding to the body boss portion 19A, and the inner diameter d21 of an inner seal face 21*a* of the ring is slightly smaller than the inner diameter d19 of the inner circumferential face 19*i* of the cassette member 19. The seal ring 22 is fitted into a deep inner circumferential groove 19*c* which is formed in a portion of the inner circumferential face 19*i* of the cassette member 19 and extending between the body boss portion 19A and the attaching flange portion 19B, and the second O-ring 23 is equipped on the outer circumferential side of the ring in a state where the O-ring is radially compressed. Also the inner diameter d22 of the inner circumferential face 22*a* of the seal ring 22 is slightly smaller than the inner diameter d19 of the inner circumferential face 19*i*.

In each of the pump flanges 4, by contrast, a stepped hole (an example of a recessed portion) 24 which has a small-diameter hole portion 24A and a large-diameter hole portion 24B, and which is used for attaching the bearing mechanism is formed while being centered on the axis P. It is configured so that the body boss portion 19A of the cassette member 19 is closely fitted to the small-diameter hole portion 24A, and the attaching flange portion 19B of the cassette member 19 is closely or loosely fitted to the large-diameter hole portion 24B. The width dimension of the cassette member 19 and the thickness dimension of the pump flange 4 are set to be equal to each other, and it is configured so that, in a state where the bearing mechanism B is fitted and attached to the stepped hole 24, an inner end face 19*d* of the cassette member 19 and the inner side face 4*a* of the pump flange 4 are flush with each other, and an outer end face 19*e* of the cassette member 19 and the outer side face 4*b* of the pump flange 4 are flush with each other. The reference numeral 34 in FIGS. 2 and 3 denotes a frame wall which is projectingly formed from the pump flange 4 in order to allow the end cover 7 to be fitted thereonto.

The fixation of the bearing mechanism B to the pump flange 4 is performed by fastening the attaching flange portion 19B to an outer peripheral edge portion of the small-diameter hole portion 24A of the pump flange 4 by a plurality of bolts 25. According to the structure, when the plural bolts 25 are removed, as shown in FIG. 5, taking out from the pump flange 4 by outward pulling out moving the bearing mechanism B, and attachment by insertion to the stepped hole 24 can be freely performed. In the case where the bearing ring 21 or the seal ring 22 is to be replaced because of wear or the like, therefore, the replacement can be easily performed in the following manner. The four nuts 18*a* are operated and the connecting plate 17 is detached from the connecting rods 18, thereby exposing the pump flange 4. Then, the plural bolts 25 are operated to detach the bearing mechanism B from the pump flange 4 and the pump shaft 15. The detached bearing mechanism B is operated.

In order to detachably support the bearing mechanism B which slidably supports the pump shaft 15, by the pump flange 4, namely, the cassette member 19 equipped with the bearing ring (an example of a ring-like bearing) 21 and seal ring 22 which are fitted onto the pump shaft 15 is attached to the pump flange 4 in a state where the cassette member is enabled to be detached from the pump flange 4 toward the connecting plate 17. Because of the employment of the cassette type bearing mechanism B which can be attached and detached with respect to the pump flange 4, an advantage that the maintenance property of maintenance check and the like is largely improved as described above is obtained.

In the above-described conventional reciprocating pump disclosed in the Patent Reference 1 or the like, the bearing ring is disposed directly on the pump flange. When the bearing ring is to be replaced, therefore, also the pump flange must be disassembled, and a very bothersome and cumbersome work is requested. In the reciprocating pump of the invention, by contrast, the bearing mechanisms B are configured so as to be attachable and detachable laterally outward from the pump flanges 4. Therefore, it is not required to perform an operation of removing the pump flanges 4, and, in replacement or maintenance check of the bearing rings 21 or the seal rings 22, it is possible to perform maintenance easily and conveniently while removing the bearing mechanisms B.

Next, the slide supporting structure for the connecting rods 18 will be described. As shown in FIGS. 2 and 6, each of the bearing portions 11 is fitted into and supported by the slide bearing (an example of a slide bearing) 27 which is housed in the stepped hole 26 formed in the pump flange 4, and which has a stepped cylindrical shape. An end portion of the cover cylinder 6 which houses the connecting rod 18 is inserted into a large-diameter hole portion 26A of the pump flange 4 in a state where the portion is pressingly fitted onto a small-diameter portion 27*b* of the slide bearing 27. Namely, the configuration where the cover cylinder 6 is indirectly supported by the pump flange 4 through the slide bearing 27 is employed.

As shown in FIGS. 6 and 7, the slide bearing 27 has: an inner circumferential face 27A into which the connecting rod 18 is slidably closely fitted; a large-diameter portion 27*a* which is pressingly fitted into the large-diameter hole portion 26A of the stepped hole 26; and a small-diameter portion 27*b* which is smaller in diameter than the large-diameter portion 27*a*, and is configured as a bearing member in which a vertical slit (an example of a slit) 28 that is passed through along the width direction of the bearing, i.e., the direction of the axis X of the connecting rod 18 is formed, and which shows a substantially C-like shape as viewed in the direction of the axis X. Namely, the slide bearing 27 is formed into a slit cylindrical shape which is fitted onto the connecting rod 18 having a circular section, and in which the vertical slit 28 extending along the direction of the axis X of the connecting rod 18 is formed, and a section shows a C-like shape.

Because of the configuration where the slide bearing 27 which is fitted into and supported by the stepped hole 26 of the pump flange 4, and which has a role of closely and inward fitting the connecting rod 18 in a slidable manner is formed into a C-like shape, the following functions and effects are obtained. Namely, even in the case where the slide bearing 27 is expanded by a change of the ambient temperature, sliding heat, or the like, only elongation is produced in a direction (the circumferential direction) along which the gap of the vertical slit 28 is reduced, and the excellent fitting state with the connecting rod 18, and the excellent fitting state with the pump flange 4 can be maintained. Conversely, even when material contraction is caused by temperature reduction in the winter season or the like, only a change is caused in a direction along which the gap of the vertical slit 28 is slightly increased, and similarly the excellent fitting states with the connecting rod 18 and the pump flange 4 can be maintained. Furthermore, also in the case where the connecting portion 17 or the pump flange 4 is expanded or contracted, it is possible to attain functions and effects which are similar to those described above.

The motion (function) of the reciprocating pump A will be schematically described. High pressure air is complementarily supplied to or discharged from the air supplying/discharging ports a, a of the pump flanges 4 (means for supplying the air to one of the ports, and reducing the pressure of the other port may be possible) to cause the pair of air cylinders 3, 3 to complementarily expand and contract (as shown in FIG. 3, air flow paths 33 through which the air supplying/discharging ports a and the cylinder chambers 3*a* communicate with each other are formed in the pump flange 4), whereby the pair of diaphragms 2, 2 can be complementarily expanded and contracted to continuously eject the fluid sucked from the fluid sucking port 12, from the fluid ejecting port 13. Referring to FIG. 2, the bellows 2 which is drawn on the right side of the pump body 1 is shown in a state of the end of the ejecting operation where the bellows is most contracted by expansion of the cylinder chamber 3*a*, the suction check valve 9 is closed, and the ejection check valve 10 is opened. The bellows 2 which is drawn on the left side of the pump body 1 is shown in a state of the end of the sucking operation where the bellows is most expanded by contraction of the cylinder chamber 3*a*, the suction check valve 9 is opened, and the ejection check valve 10 is closed.

Figure 8:
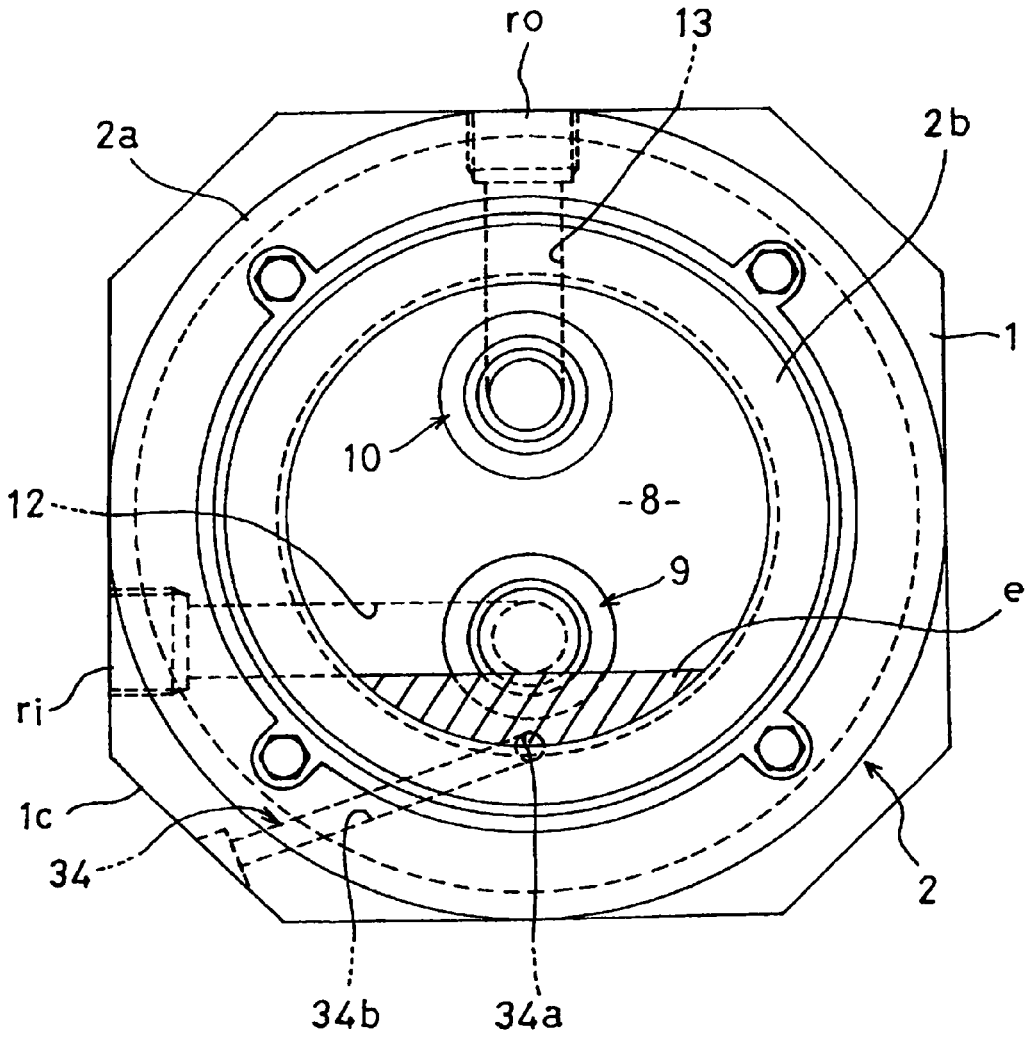
FIG. 8 is a sectional view of a pump body portion showing a drain path.

Although described for reference, as shown in FIGS. 2 and 8, a drain path 34 for discharging liquid remaining in the pump chambers 8 is formed in the pump body 1. Namely, the drain path 34 is configured by: a lateral hole 34*a* which is opened in the pump chamber 8 in a state where the hole extends between the outer circumferential portion 1*a* that is in the pump body 1, and that supports the thick flange portion 2*a*, and the inner peripheral wall 1*b*; and an inclined vertical hole 34*b* which is opened in a downward inclined outer wall 1*c* of the pump body 1 while communicating with the inner rear end of the lateral hole 34*a*. Although not illustrated, an opening portion of the inclined vertical hole 34*b* is closed in a usual (non-drainage) state by a plug, a valve, or the like. If required, the plug or the like is removed, so that the liquid (medical solution) e remaining in the pump chamber 8 can be discharged from the drain path 34 by using the gravity. The ejection-side flow path 13 may have a structure where the liquid is upward taken out as shown in FIG. 8.

Conventionally, even when the pump P is idly operated to extract the liquid from the pump chamber 8, the liquid which stays below the level of the opening portion of the suction check valve 9 cannot be extracted. By contrast, the disposition of the drain path 34 enables liquid remaining in the pump chamber 8 to be completely discharged by using the gravity without using a special mechanism. Therefore, an advantage that the liquid amount and time required in liquid replacement can be reduced rationally and economically is obtained. For the sake of simplicity, in FIG. 2, the drain path 34 is drawn only in the right pump chamber 8. However, actually, it is preferable that the drain path 34 is disposed in each of the pump chambers 8, 8.

OTHER EXAMPLES

The diaphragms 2 may be diaphragms and are not restricted to bellows. The number of the connecting rods 18 may be a number other than four, such as two or six.

The invention claimed is:

1. A reciprocating pump having:

a pump body comprising a suction path for a to-be-transported fluid, a discharge path for a to-be-transported fluid and respective end portions;

a pair of diaphragms which are airtightly fixed to respective ones of said end portions of said pump body, and which are placed opposite to one another to form closed spaces with respect to said pump body respectively;

pump shafts which are attached to said tip end portions of said diaphragms;

a pair of pump flanges which slidably support said pump shafts, and which are located at respective ends of said pump body and are integrated with said pump body through connection bodies that are placed outside said diaphragms, each of said pump flanges include large diameter holes at a plurality of locations;

connecting rods which connect connecting plates, attached to passing projecting portions that are outward projected from said pump flanges in said pump shafts, to each other in a state where said connecting rods are passed through said pump flanges to be placed outside said diaphragms; and a cover cylinder for each connecting rod which surrounds its respective connecting rod in a state where said cover cylinder is disposed between said pair of pump flanges; wherein slide bearings are associated with each connecting rod and are mounted in the large diameter holes in said pump flange, each slide bearing having a stepped shape including a small diameter portion, which is press-fitted into an end of the cover cylinder, and a large diameter portion, which has the same outside diameter as the cover cylinder; and wherein said connecting rods are slidably supported through said slide bearings which are supported by said pump flanges.

2. A reciprocating pump according to claim 1, wherein:

said connecting rods each have a circular section;

said slide bearings have a cylindrical shape including a slit along its longitudinal extent; and said slide bearings being formed into a C-like shape.

3. A reciprocating pump according claim 1, wherein:

in order to detachably support bearing mechanisms which slidably support said pump shafts, from said pump flanges, cassette members equipped with ring-like bearings and seal rings which are fitted onto said pump shafts are attached to said pump flanges in a state where said cassette members are enabled to be detached from said pump flanges toward said connecting plates.

4. A reciprocating pump according to claim 1, wherein:

said diaphragms are formed into a bellows having: a thick flange portion which is attached to said pump body; a tip-end thick plate portion which is attached to a plate-like member equipped in a root portion of said pump shaft; and a bellows portion which is formed in a state where said bellows portion extends from said thick flange portion to said tip-end thick plate portion.

5. A reciprocating pump according to claim 2, wherein:

in order to detachably support bearing mechanisms which slidably support said pump shafts, from said pump flanges, cassette members equipped with ring-like bearings and seal rings which are fitted onto said pump shafts are attached to said pump flanges in a state where said cassette members are enabled to be detached from said pump flanges toward said connecting plates.

6. A reciprocating pump according to claim 2, wherein:

said diaphragms are formed into a bellows having: a thick flange portion which is attached to said pump body; a tip-end thick plate portion which is attached to a plate-like member equipped in a root portion of said pump shaft; and a bellows portion which is formed in a state where said bellows portion extends from said thick flange portion to said tip-end thick plate portion.

7. A reciprocating pump according to claim 3, wherein:

said diaphragms are formed into a bellows having: a thick flange portion which is attached to said pump body; a tip-end thick plate portion which is attached to a plate-like member equipped in a root portion of said pump shaft, and a bellows portion which is formed in a state where said bellows portion extends from said thick flange portion to said tip-end thick plate portion.

* * * * *